US005245715A

United States Patent [19]

Dinkins

[11] Patent Number: 5,245,715

[45] Date of Patent: Sep. 21, 1993

[54] BLANKET ANCHOR APPARATUS

[76] Inventor: Jeffery A. Dinkins, 4615 Hayes St., Gary, Ind. 46408

[21] Appl. No.: 881,172

[22] Filed: May 11, 1992

[51] Int. Cl.[5] ..... A47G 9/06

[52] U.S. Cl. ..... 5/417; 5/418; 135/118; 248/508

[58] Field of Search ..... 5/417–420; 135/118; 248/508; 24/72.5

[56] References Cited

U.S. PATENT DOCUMENTS

| | | | |
|---|---|---|---|
| 2,840,092 | 6/1958 | Hill | 135/118 |
| 2,898,924 | 8/1959 | Gesser | 135/118 |
| 2,901,789 | 9/1959 | Frank | 135/118 |
| 2,939,468 | 6/1960 | Boyce | 5/417 |
| 3,241,202 | 3/1966 | Knauft | 135/118 |
| 3,263,692 | 8/1966 | Questi et al. | 135/118 |
| 5,176,354 | 1/1993 | Feigenbaum, Jr. | 135/118 |

FOREIGN PATENT DOCUMENTS 604273 9/1934 Fed. Rep. of Germany ..... 5/417

*Primary Examiner*—Alexander Grosz
*Attorney, Agent, or Firm*—Leon Gilden

[57] ABSTRACT

A blanket member as is typically utilized as a covering for a beach and the like includes a plurality of clip fasteners arranged for securement about a periphery of the blanket, with each of the clip members including a tether line secured at one end to an associated clip member and at an opposed end to a conical anchor plug. The anchor plug is arranged with concentric rings spaced along the anchor plug to maintain securement of the anchor structure relative to a beach environment. A modification of the invention includes rack structure to accommodate further webs for drying and for purposes of shade and the like.

3 Claims, 4 Drawing Sheets

BLANKET ANCHOR APPARATUS

BACKGROUND OF THE INVENTION

1. Field of the Invention

The field of invention relates to blanket anchor structure, and more particularly pertains to a new and improved blanket anchor apparatus wherein the same is arranged for the securement of a blanket relative to a beach environment.

2. Description of the Prior Art

Blankets as typically utilized in outdoor events such as upon a beach are subject to displacement due to wind, manual manipulation, and the like. The instant invention attempts to overcome deficiencies of the prior art by providing for anchoring structure that is selectively mounted about a periphery of an associated blanket to secure the blanket relative to the beach environment and in this respect, the present invention substantially fulfills this need.

SUMMARY OF THE INVENTION

In view of the foregoing disadvantages inherent in the known types of blanket anchoring apparatus now present in the prior art, the present invention provides a blanket anchor apparatus wherein the same utilizes a clip member in cooperation with an anchor to secure a blanket structure relative to a beach environment. As such, the general purpose of the present invention, which will be described subsequently in greater detail, is to provide a new and improved blanket anchor apparatus which has all the advantages of the prior art blanket anchor apparatus and none of the disadvantages.

To attain this, the present invention provides a blanket member as a covering for a beach and the like, including a plurality of clip fasteners arranged for securement about a periphery of the blanket, with each of the clip members including a tether line secured at one end to an associated clip member and at an opposed end to a conical anchor plug. The anchor plug is arranged with concentric rings spaced along the anchor plug to maintain securement of the anchor structure relative to a beach environment. A modification of the invention includes rack structure to accommodate further webs for drying and for purposes of shade and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved blanket anchor apparatus which has all the advantages of the prior art blanket anchor apparatus and none of the disadvantages.

It is another object of the present invention to provide a new and improved blanket anchor apparatus which may be easily and efficiently manufactured and marketed.

It is a further object of the present invention to provide a new and improved blanket anchorn apparatus which is of a durable and reliable construction.

An even further object of the present invention is to provide a new and improved blanket anchor apparatus which is susceptible of a low cost of manufacture with regard to both materials and labor, and which accordingly is then susceptible of low prices of sale to the consuming public, thereby making such blanket anchor apparatus economically available to the buying public.

Still yet another object of the present invention is to provide a new and improved blanket anchor apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of the modified anchor unit structure.

DESCRIPTION OF THE PREFERRED EMBODIMENT

Figure 1:
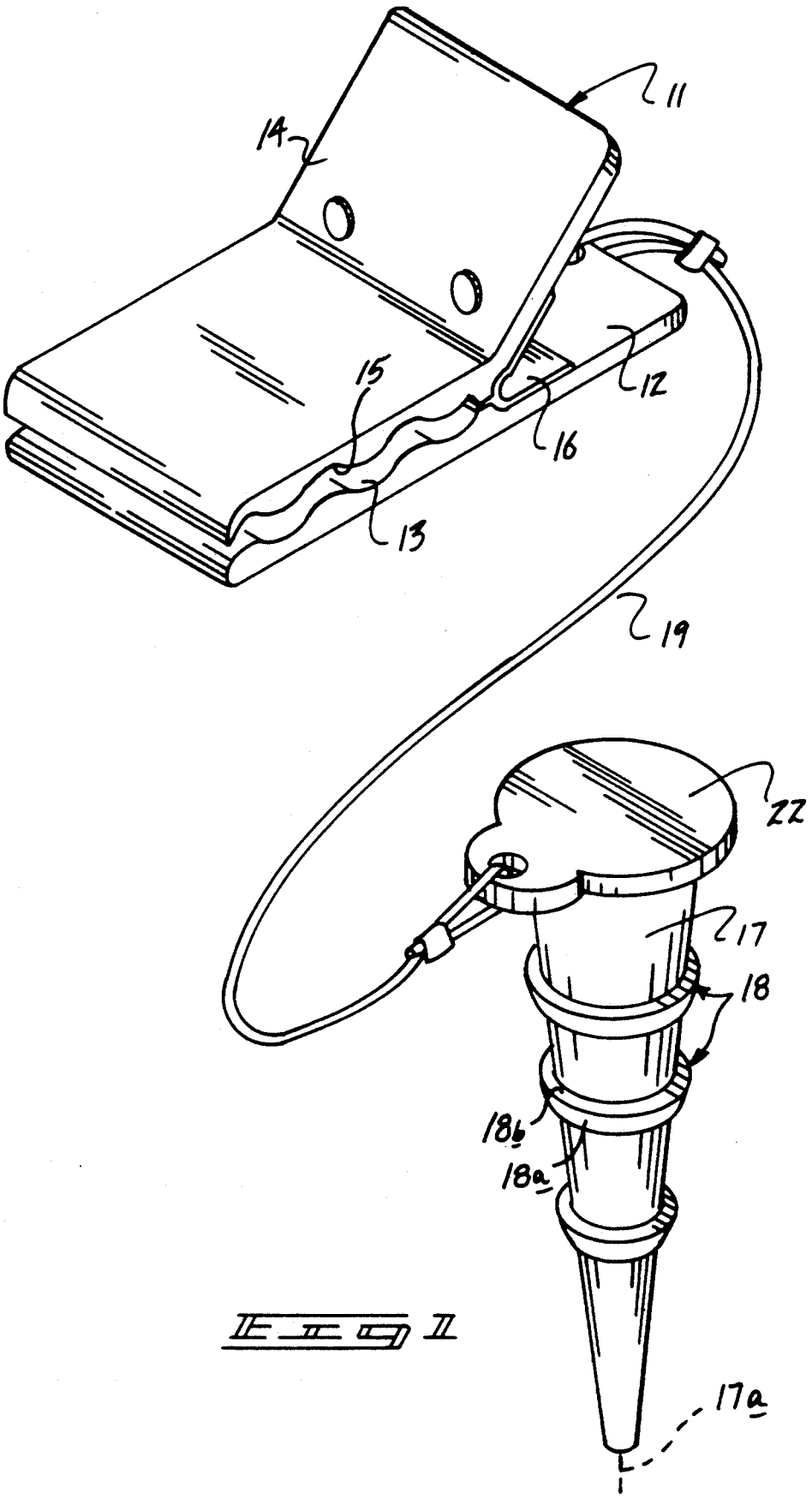
FIG. 1 is an isometric illustration of a blanket anchor unit that is utilized by the invention.

With reference now to the drawings, and in particular to FIGS. 1 to 5 thereof, a new and improved blanket anchor apparatus embodying the principles and concepts of the present invention and generally designated by the reference numeral 10 will be described.

More specifically, the blanket anchor apparatus 10 of the instant invention essentially comprises a plurality of clamp members 11 (see FIG. 2), each secured about a periphery of an associated blanket web 20. Each clamp member 11 includes a base plate 12 having a first undulating jaw 13 projecting longitudinally aligned relative to the base plate 12 defining a planar bottom surface relative to the base plate 12, with a first undulating jaw 13 arranged in confrontation with the second undulating jaw 15. The second undulating jaw 15 includes a movable clamp plate 14 arranged for cooperation and over the base plate 12 defining a generally acute angle therebetween in a first position to permit depressing of the movable clamp plate 14 relative to the base plate 12, with a spring hinge 16 interposed at a junction of the base plate 12 with the movable plate 14 to bias the first and second jaws in a contiguous relationship, as illustrated, to permit securement of the blanket 20 therebetween.

Figure 2:
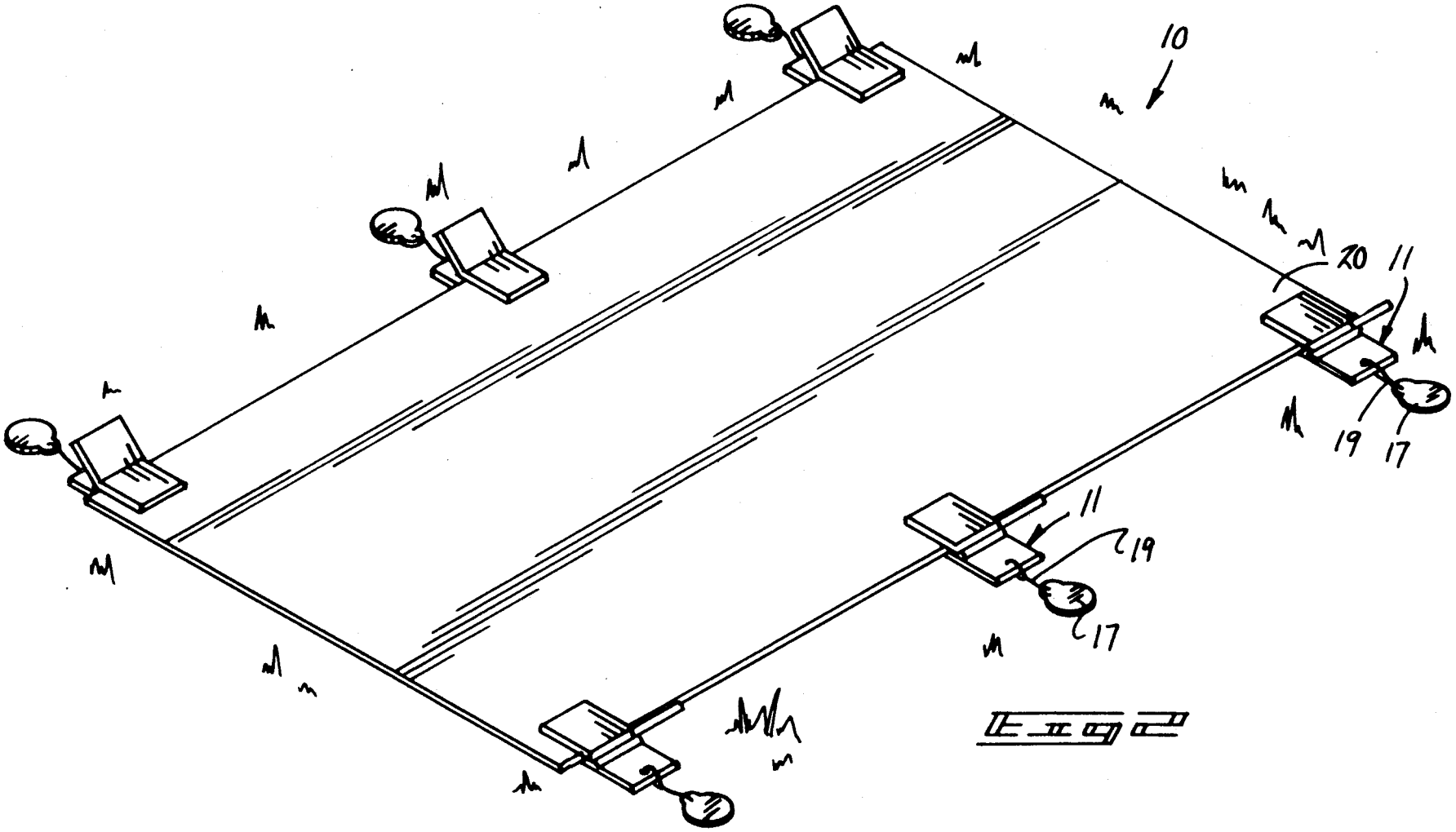
FIG. 2 is an isometric illustration of the invention.

Each clamp member 11 includes a conical rigid annular plug 17 spaced from the clamp member 11 having a tether line 19 securing the anchor plug 17 to the base plate 12. The tether line 19 is secured to an anchor plug lid 22 that projects laterally beyond an upper end of the anchor plug. The anchor plug 17 is defined about an axis 17*a*, with a plurality of concentric lock rings 18 fixedly mounted about an outer periphery of the anchor plug 17 spaced therealong, with each ring including a conical ring outer wall 18*a* canted downwardly towards a lower distal end of the anchor plug, with each ring including a planar ring top wall 18*a* that is orthogonally oriented relative to the axis 17*a*. The ring structure 18 enhances anchoring and securement of each anchor relative to a beach surface, such as illustrated in FIG. 2.

Figure 3:
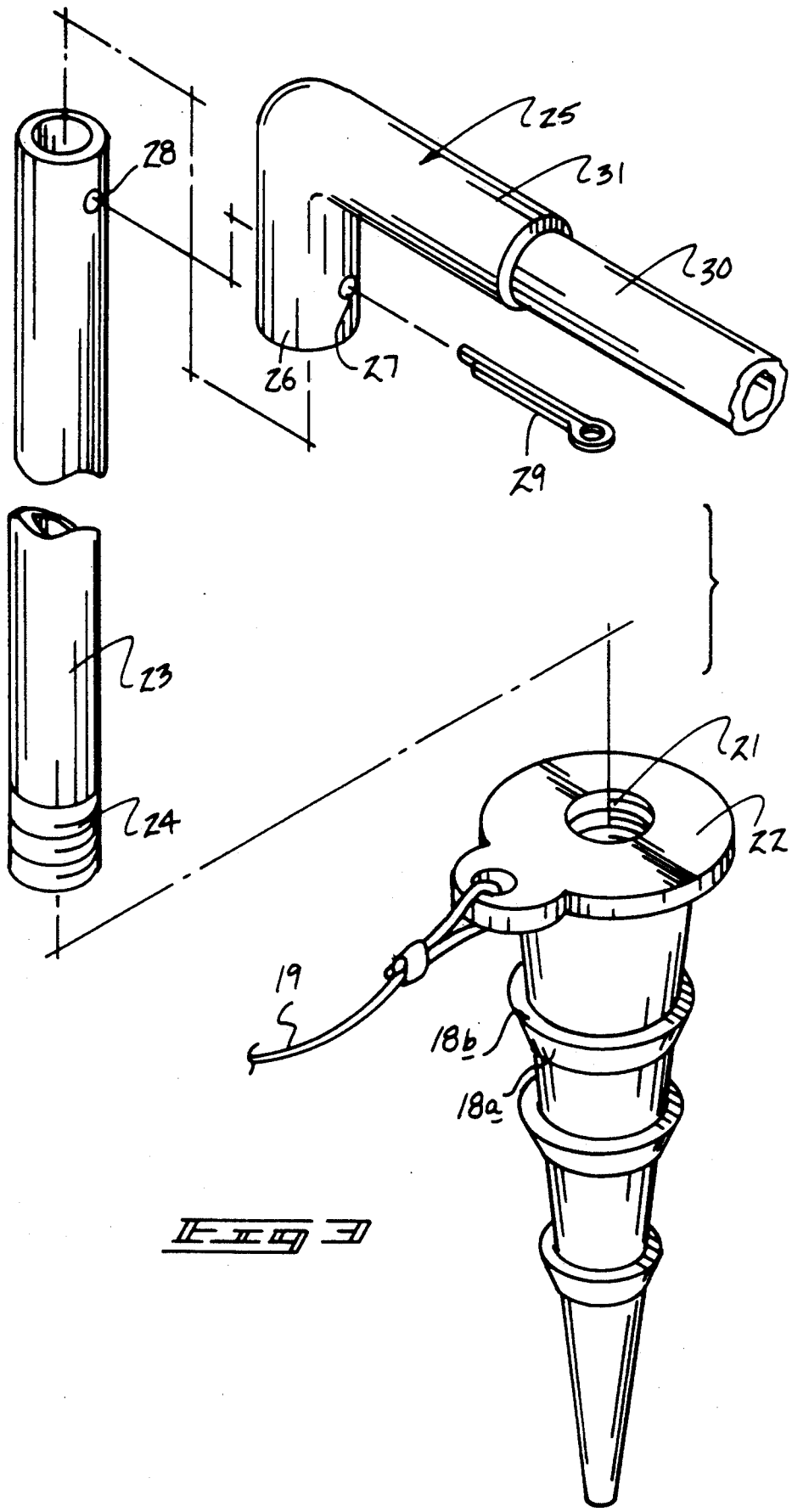
FIG. 3 is an isometric exploded view of a modified anchor member as utilized by the invention.

The FIG. 3 utilizes an optional internally threaded anchor bore 21 coaxially aligned relative to the axis 18*a* directed through the lid 22. A vertical support leg 23 is directed into the anchor bore 21 at a lower threaded end 24. An angular joint 25 includes a first leg 26 orthogonally oriented relative to a second leg 31. The first leg includes a first leg bore orthogonally directed through the first leg for coaxial alignment with a support leg bore 28 adjacent an upper distal end of the support leg 23, with a lock pin 29 directed through the first leg bore 26 and the support leg bore 28 when thusly aligned. It should be noted that a plurality of such angular joints and associated anchors 17 having anchor bores 21 are utilized at a minimum, such as in a manner as illustrated in FIG. 4, to define a U-shaped framework to accommodate various garments for drying purposes or for affording shade to individuals reclining on the blanket web 20.

Figures 4A, 5:
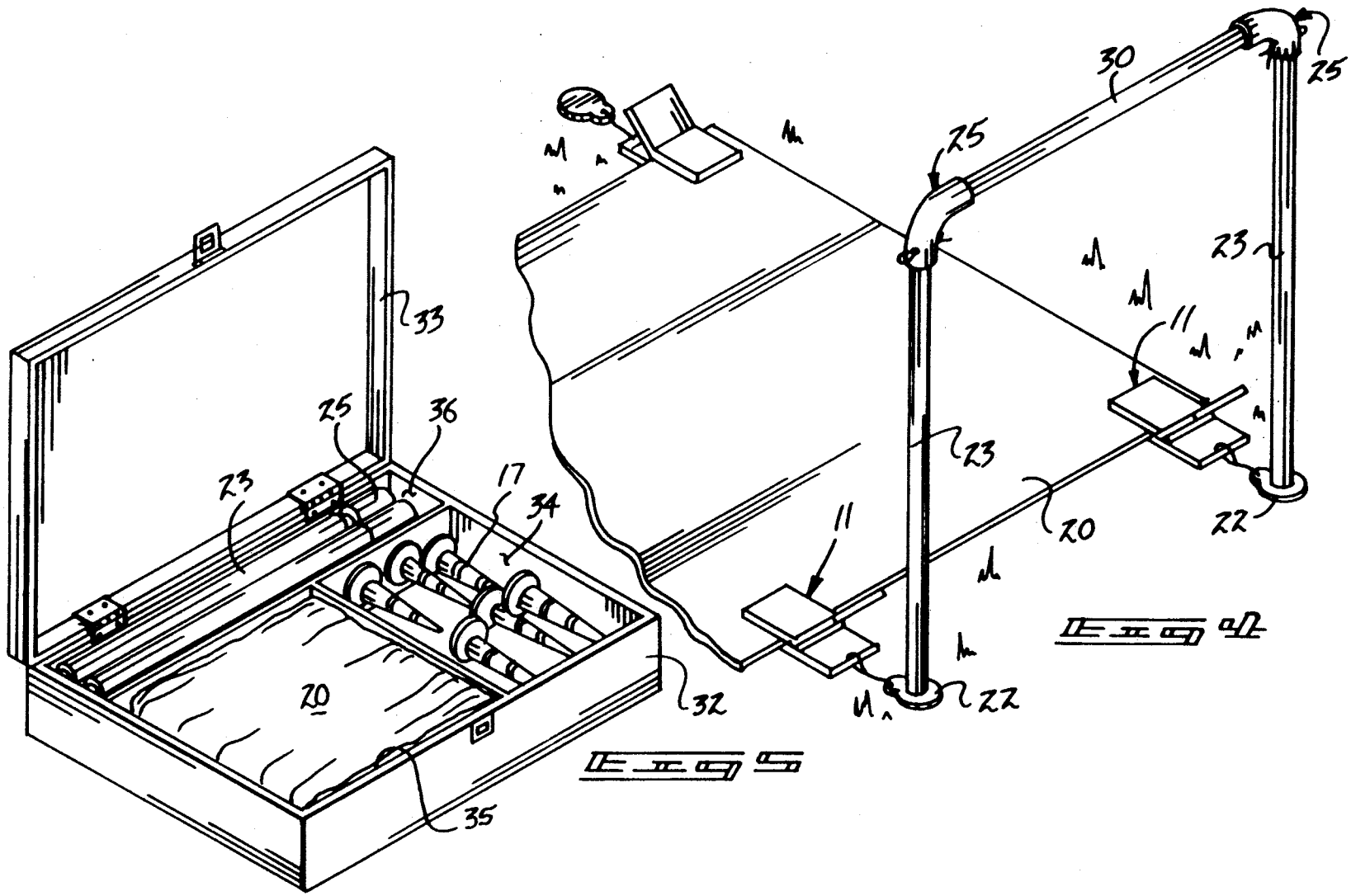
FIG. 5 is an isometric illustration of the invention arranged in a collapsed configuration for storage and transport thereof.

The FIG. 5 illustrates the use of a storage container 32 having a container lid 33 hingedly mounted thereto, with the storage container 32 including a first, second, and third compartment 34, 35, and 36 respectively. The first, second, and third compartments receive various components of the organization such as the anchors 17, the blanket web 20, and the associated support leg and angular joints 23 and 25 respectively for the convenience of storage and transport of the organization during periods of non-use.

As to the manner of usage and operation of the instant invention, the same should be apparent from above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A blanket anchor apparatus, comprising, a blanket web having an outer peripheral edge, and a plurality of clamp members arranged for securement about the outer peripheral edge, with each clamp member of said plurality of clamp members including a first jaw cooperative with a second jaw, and a first plate arranged in a coplanar relationship relative to the first jaw, and a second plate arranged at an oblique angular relationship relative to the second jaw, with the second plate positioned above the first plate, and a spring hinge interposed between the first plate and the second plate at an intersection of the first plate and the second plate, and each clamp member including an anchor plug and a tether line, with the tether line including a first end secured to the first plate, the tether line including a second end secured to the anchor plug. the anchor plug including an anchor plug lid, with the tether line second end secured to the anchor plug lid, with the anchor plug lid projecting peripherally beyond an upper end of the anchor plug receiving the tether line second end, wherein at least a pair of anchor plugs include an anchor bore coaxially aligned along an axis of each of said pair of anchor plugs, and a plurality of vertical support legs each having a leg lower distal end, wherein each leg lower distant end is received within a respective anchor bore of said pair of anchor plugs, and said pair of vertical support legs each include a leg upper distal end, and each leg upper distal end includes an angular joint secured thereto, and each angular joint receives a horizontal support leg, wherein said horizontal support leg and said pair of vertical support legs define a U-shaped framework.

2. An apparatus as set forth in claim 1 wherein each anchor plug includes an outer peripheral surface defined about an axis, and the outer peripheral surface includes a plurality of spaced lock rings mounted about the outer peripheral surface, and each lock ring includes a top wall orthogonally oriented relative to the axis, and an outer wall canted downwardly relative to the top wall intersecting the outer peripheral surface.

3. An apparatus as set forth in claim 1 including a storage container, the storage container having a lid, and the storage container including a first compartment, a second compartment, and a third compartment, the first compartment receiving said plurality of anchor plugs, said second compartment receiving said blanket web, and said third compartment receiving said horizontal support leg, said plurality of vertical support legs, and said plurality of angular joints.

* * * * *